US010852680B2

(12) United States Patent
Weinstein et al.

(10) Patent No.: US 10,852,680 B2
(45) Date of Patent: Dec. 1, 2020

(54) PRINT SUBSTRATE SURFACE MODIFICATION

(71) Applicant: HP INDIGO B.V., Amstelveen (NL)

(72) Inventors: Tamir Weinstein, Rehovot (IL); Dror Kella, Ness Ziona (IL); Dafna Or-Chen, Ness Ziona (IL); Martin Chauvin, Tel Aviv (IL); Shahar Stein, Zur Yizhak (IL)

(73) Assignee: HP Indigo B.V., Amstelveen (NL)

( * ) Notice: Subject to any disclaimer, the term of this patent is extended or adjusted under 35 U.S.C. 154(b) by 335 days.

(21) Appl. No.: 15/569,470

(22) PCT Filed: Jul. 31, 2015

(86) PCT No.: PCT/EP2015/067650

§ 371 (c)(1),
(2) Date: Oct. 26, 2017

(87) PCT Pub. No.: WO2017/020925

PCT Pub. Date: Feb. 9, 2017

(65) Prior Publication Data

US 2018/0088506 A1 Mar. 29, 2018

(51) Int. Cl.
*B41M 5/00* (2006.01)
*G03G 15/00* (2006.01)

(52) U.S. Cl.
CPC ..... *G03G 15/5029* (2013.01); *B41M 5/0011* (2013.01); *G03G 2215/00763* (2013.01); *G03G 2215/00801* (2013.01)

(58) Field of Classification Search
CPC ..... B41M 5/0011; G03G 2215/00763
See application file for complete search history.

(56) References Cited

U.S. PATENT DOCUMENTS 6,601,729 B1 * 8/2003 Papp ..... A61J 7/0084 206/528
7,609,999 B2 10/2009 Gila et al.
(Continued)

FOREIGN PATENT DOCUMENTS

CN 201198229 2/2009
CN 102689394 9/2012
(Continued)

OTHER PUBLICATIONS

Unknown, "HP Indigo Digital Offset Color Technology", White Paper, Mar. 2015, 9 pages, 4AA1-5248ENW, Hewlett-Packard Development Company, L.P.

*Primary Examiner* — Nathan H Empie
(74) *Attorney, Agent, or Firm* — Trop Pruner & Hu PC

(57) ABSTRACT

There is provided a method and apparatus for preparing a print substrate. A surface resistivity of a print substrate comprising a conductive layer is determined. The determined surface resistivity is compared to a print range having a lower threshold value for the surface resistivity of the print substrate and an upper threshold value for the surface resistivity of the print substrate. If the determined resistivity of the print substrate is outside the print range, a surface modification is selected to adjust the determined surface resistivity of the print substrate to fall within the print range. The selected surface modification is applied to the top layer of the print substrate.

9 Claims, 8 Drawing Sheets

(56) References Cited

U.S. PATENT DOCUMENTS

| | | | | |
|---|---|---|---|---|
| 2005/0048406 | A1* | 3/2005 | Burberry | H05K 3/02 430/311 |
| 2005/0104252 | A1* | 5/2005 | Hirai | H02K 15/12 264/272.19 |
| 2009/0324902 | A1* | 12/2009 | Tokunaga | G03C 1/853 428/195.1 |
| 2011/0104441 | A1 | 5/2011 | Bhattacharyya | |
| 2015/0111149 | A1 | 4/2015 | Chun | |

FOREIGN PATENT DOCUMENTS

| | | | | |
|---|---|---|---|---|
| EP | 0245092 | | 11/1987 | |
| GB | 2291603 | | 1/1996 | |
| WO | WO-2008154231 | A2 * | 12/2008 | C08K 3/04 |

* cited by examiner

PRINT SUBSTRATE SURFACE MODIFICATION

BACKGROUND

In a liquid electrophotography (LEP) image printing process, a negatively charged print material (such as ink) is electrostatically provided onto a photoconductive sheet (known as a Photo Imaging Plate, PIP) mounted onto an imaging cylinder to create a print material image. The print material image is transferred from the photoconductive sheet onto a positively charged blanket cylinder, on which it is heated to create a final image in the form of a thin tacky film. The final image film is then transferred from the blanket cylinder onto a print substrate (or print media) moving between the blanket cylinder and a grounded impression cylinder on which it is held.

BRIEF DESCRIPTION OF DRAWINGS

For a more complete understanding, various examples will now be described below with reference to the accompanying drawings in which.

DETAILED DESCRIPTION

Some examples described herein provide a method and apparatus for preparing a print substrate (or print media) prior to an image printing process. There is also provided a print substrate and method comprising printing an image using the print substrate.

The present subject-matter is further described with reference to FIGS. 1, 2, 3, 4, 5, 6 and 7. It should be noted that the description and figures merely illustrate principles of the present subject-matter. It is thus understood that various arrangements may be devised that, although not explicitly described or shown herein, embody the principles of the present subject-matter. Moreover, all statements herein reciting principles and examples of the present-subject matter, as well as specific examples thereof, are intended to encompass equivalents thereof.

Figure 1:
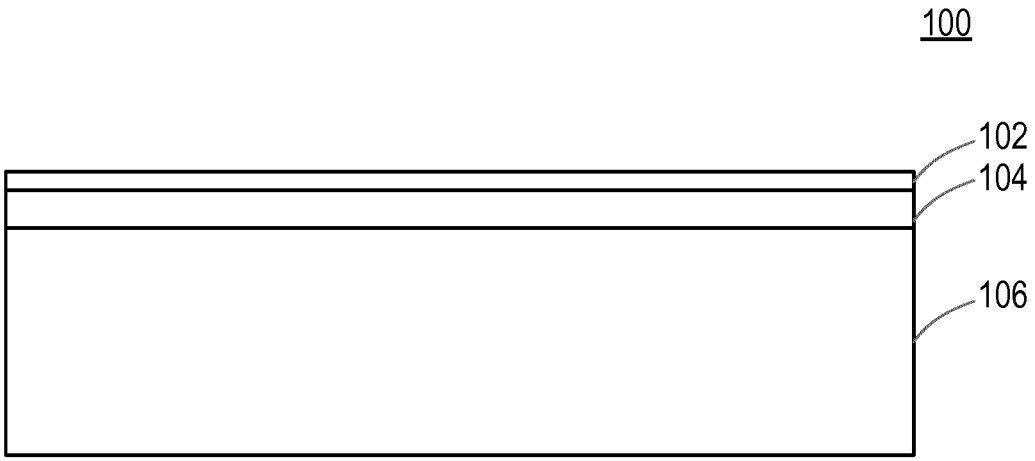
FIG. 1 is a block diagram of an example of a print substrate according to the present disclosure.
Figure 2:
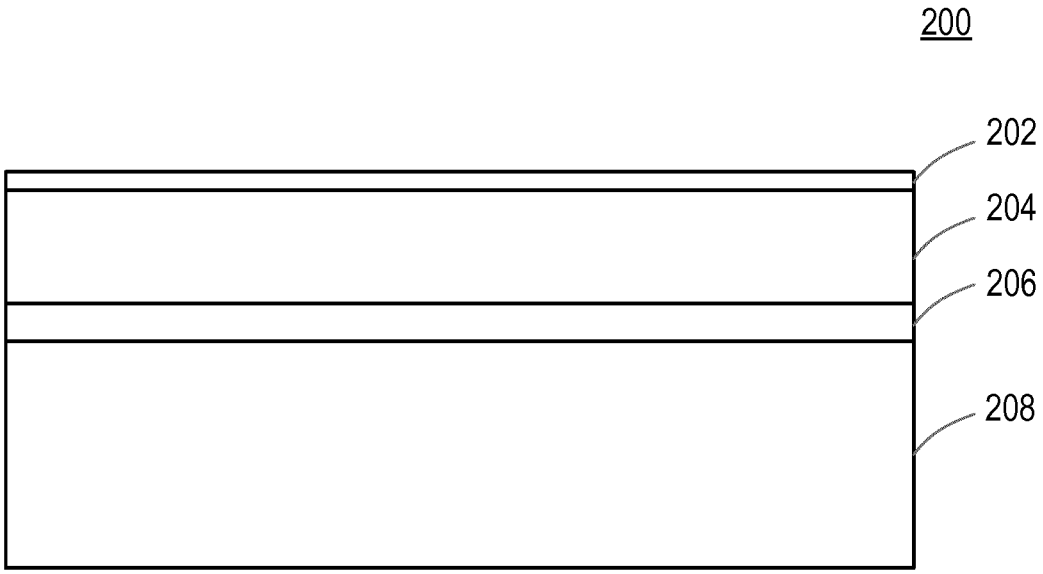
FIG. 2 is a block diagram of an example of a print substrate according to the present disclosure.

FIGS. 1 and 2 illustrate two example configurations of a print substrate (or print media) 100, 200 according to the present disclosure. The print substrates 100, 200 are metallic substrates, which may also be referred to as a metallic media (or metallic paper).

FIG. 1 illustrates an example print substrate 100. The print substrate 100 comprises a conductive top layer (for example, a metallic top layer) 104. According to the present disclosure, a surface modification 102 is applied to the conductive top layer 104 of the print substrate 100, which will be described in more detail later.

The conductive top layer 104 of the print substrate 100 may comprise a conductive material. In some examples, the conductive material may be a metal (such as aluminium or any other metallic material). In some examples, the conductive material may be a material such as carbon, Indium Tin Oxide (ITO), or the like. The edges of the conductive top layer 104 may be free or encapsulated.

The conductive top layer 104 may be formed on a base layer 106. The base layer 106 may comprise, for example, a synthetic based material or a paper based material (e.g. paperboard) or any other type of synthetic based material. The surface of the base layer 106 may be coated or uncoated. In one example, the base layer 106 may comprise an uncoated 300 gsm paper board.

The layers of the print substrate 100 shown in FIG. 1 may be formed by any suitable process. In an example process, the conductive top layer 104 (for example, a sheet of Aluminized Mylar) may be laminated on to a mechanically stable base layer 106 (for example, a paper board substrate) with the metal part of the conductive layer 104 either facing down into the base layer 106 or facing up to the air. The print substrate 100 may then be trimmed to a certain size. In one example, where the conductive top layer 104 is a sheet of Aluminized Mylar, the Aluminium part of the conductive top layer 104 may be of equal size to the Mylar, creating exposed metal edges or may be smaller in size, creating encapsulated edges. The Aluminized Mylar may be as large as or larger than the base layer 106 (for example, paper) and can be smaller, creating edges for gripping the substrate 100.

The conductive top layer 104 of the print substrate 100 is able to conduct electric current. In this example, the print substrate 100 may have a low surface resistivity (i.e. surface resistance). For example, the surface resistivity of the print substrate 100 may be of the order of a few Ω/sq (i.e. Ω/□) to a few hundred kΩ/□. In one example, the surface resistivity of the print substrate 100 may be less than 2 MΩ/□.

FIG. 2 illustrates an example print substrate 200. The print substrate 200 comprises a resistive top layer 204. According to the present disclosure, a surface modification 202 is applied to the resistive top layer 204 of the print substrate 200, which will be described in more detail later.

The resistive top layer 204 of the print substrate 200 may be in the form of a film and may comprise, for example, a plastic such as polyethylene terephthalate (PET), polypropylene, polymethylemetacrylate (PMMA) or any other resistive layer. The resistive top layer 204 may be transparent, mechanically stable, and/or resistive to scratches. The resistive top layer 204 may have a thickness in the range of 4 to 32 microns. However, it will be understood that other thicknesses are possible. The resistive top layer 204 may be a fully resistive plastic film. The resistive top layer 204 of the substrate 200 illustrated in FIG. 2 may have a lower dielectric strength than the conductive top layer 104 of the substrate 100 illustrate in FIG. 1.

The resistive top layer 204 may be formed on a conductive layer (for example, a metallic layer) 206. In other words, according to this example, the print substrate 200 comprises a conductive internal layer 206 covered by a resistive top layer 204. The conductive internal layer 206 may comprise, for example, a conductive material. In some examples, the conductive material may be a metal (such as aluminium or any other metallic material). In some examples, the conductive material may be a material such as carbon, Indium Tin Oxide (ITO), or the like. The edges of the conductive internal layer 206 may be free or encapsulated.

The conductive layer 206 may be formed on a base layer 208. The base layer 208 may comprise, for example, a synthetic based material such as a paper based material (e.g. paperboard) or any other type of synthetic based material. The surface of the base layer 208 may be coated or uncoated. In one example, the base layer 208 may comprise an uncoated 300 gsm paper board.

The resistive top layer is able to oppose the flow of electric current. In this example, the print substrate 100 may have a high surface resistivity (i.e. surface resistance). For example, the surface resistivity of the print substrate may be of the order of a few GΩ/□. In one example, the surface resistivity of the print substrate 200 may be greater than 2 GΩ/□.

Figure 6:
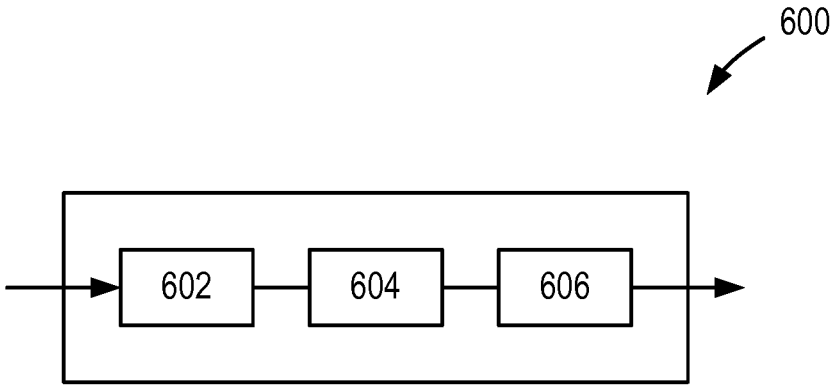
FIG. 6 is a block diagram of an example apparatus for print substrate surface modification according to the present disclosure.

FIG. 6 is a block diagram of an example apparatus 600 for print substrate 100, 200 surface modification according to the present disclosure. According to the present disclosure, a method is performed by the apparatus 600 to apply a surface modification 102, 202 to a print substrate 100, 200 comprising a conductive layer 104, 206. The apparatus 600 comprises a measurement module 602 to measure (or determine) a surface resistivity (i.e. surface resistance) of the print substrate 100, 200, a processing module 604 to process the measured (or determined) surface resistance and an application module 606 to provide (or apply) the surface modification 102, 202 to the substrate 100, 200. The method may be performed prior to printing on the print substrate 100, 200. FIGS. 3A, 3B, 3C and 3D are example illustrations of a method which may be employed according to the present disclosure.

With reference to FIGS. 3A, 3B, 3C and 3D, at block 500, 508, 516, 524, the measurement module 602 determines (or measures) a surface resistivity of the print substrate 100, 200 comprising the conductive layer 104, 206. For example, the measurement module 602 may be in the form of an electrical test equipment to determine (or measure) the surface resistivity of the print substrate 100, 200.

At block 502, 510, 518, 526, the processing module 604 compares the determined surface resistivity of the print substrate 100, 200 to a print range having a lower threshold value for the surface resistivity of the print substrate 100, 200 and an upper threshold value for the surface resistivity of the print substrate 100, 200.

Figure 3A:
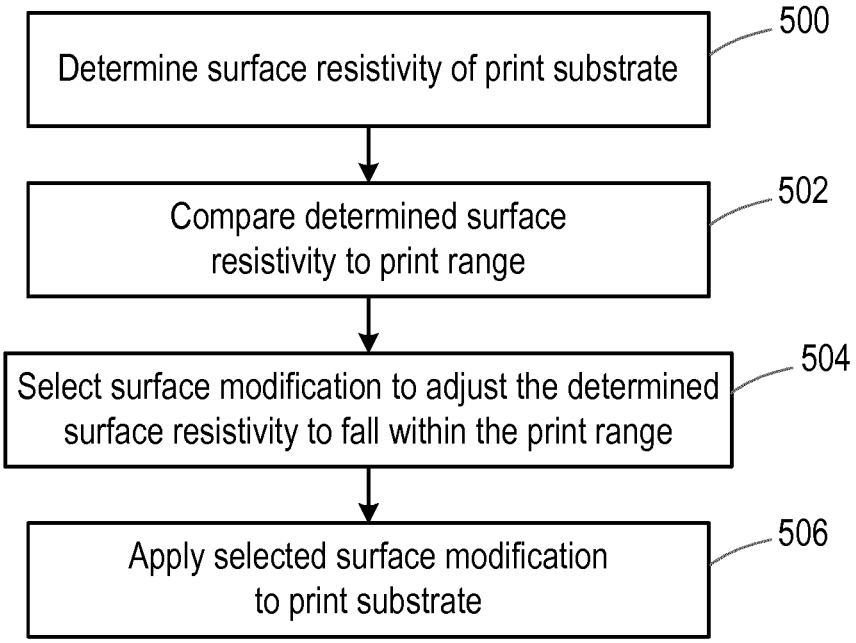
FIG. 3A is an example illustration of a method which may be employed according to the present disclosure.

As illustrated in FIG. 3A, at block 504, if the determined resistivity of the print substrate 100, 200 is outside the print range, the processing module 604 selects a surface modification 102, 202 to adjust (or alter) the determined surface resistivity of the print substrate 100, 200 to fall within (i.e. be within) the print range. In other words, the processing module 604 selects a surface modification 102, 202 depending on the determined surface resistivity of the print substrate 100, 200.

Figure 3B:
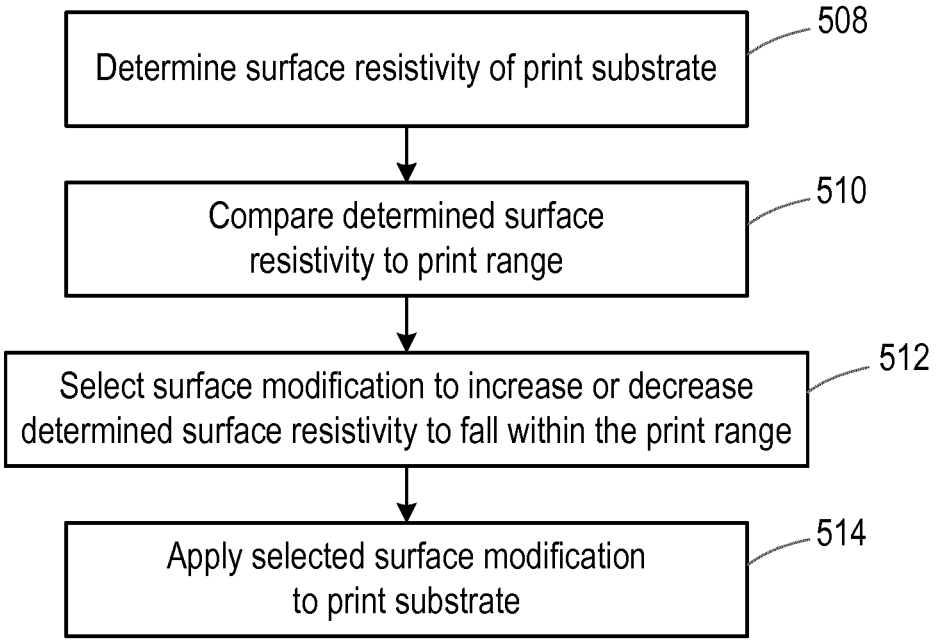
FIG. 3B is an example illustration of a method which may be employed according to the present disclosure.

In the example illustrated in FIG. 3B, at block 512, the processing module 604 may select a surface modification 102, 202, based on the determined surface resistivity of the print substrate to increase or decrease the surface resistivity of the print substrate 100, 200 to fall within the print range. For example, if the surface resistivity of the print substrate 100, 200 is determined to be below (i.e. lower or less than) the lower threshold value for the surface resistivity of the print range, the processing module 604 may select a surface modification 102, 202 to increase the surface resistivity of the print substrate 100, 200 to fall within the print range (i.e. to be more than the lower threshold value and less than the upper threshold value). If the surface resistivity of the print substrate 100, 200 is determined to be above (i.e. more or higher than) the upper threshold value of the print range, the processing module 604 may select a surface modification 102, 202 to decrease (i.e. reduce) the surface resistivity of the print substrate 100, 200 to be within the print range (i.e. to be less than the upper threshold value and more than the lower threshold value).

The surface modification 102, 202 may comprise any modification to the surface of the print substrate 100, 200 (including any material or technique applied to the surface) that can adjust the determined surface resistivity of the print substrate 100, 200 to fall within the print range. Where the surface modification comprises a material that can adjust the determined surface resistivity of the print substrate 100, 200, the material may have other functionalities aside from adjusting the determined surface resistivity of the print substrate 100, 200.

Figure 3C:
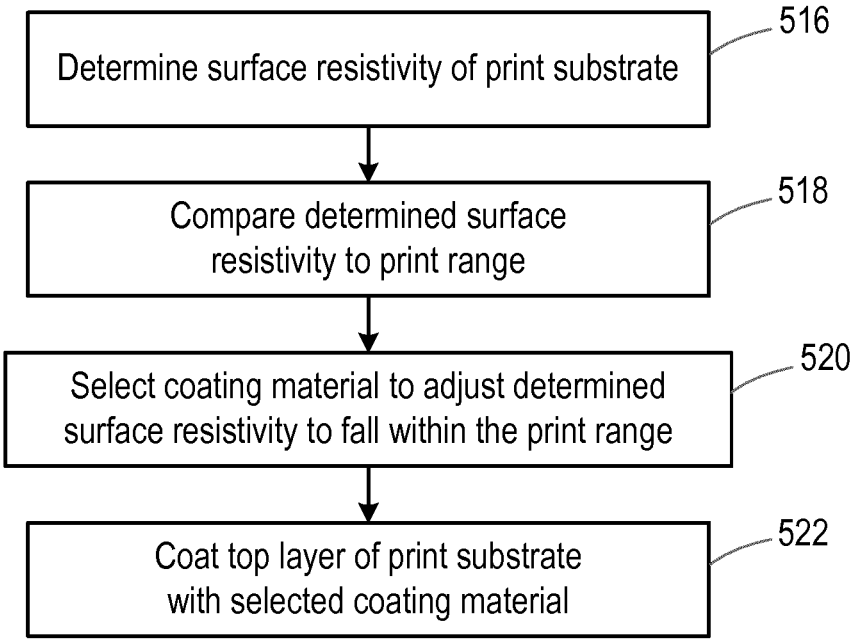
FIG. 3C is an example illustration of a method which may be employed according to the present disclosure.

In the example illustrated in FIG. 3C at block 520, selecting a surface modification 102, 202 to adjust the determined surface resistivity of the print substrate 100, 200 to fall within the print range may comprise the processing module 604 selecting a coating material to adjust the determined surface resistivity of the print substrate 100, 200 to fall within the print range. In another example, selecting a surface modification 102, 202 to adjust the determined surface resistivity of the print substrate 100, 200 to fall within the print range may comprise the processing module 604 selecting a coating material, a weight of the coating material and a thickness for the coating material to adjust the determined surface resistivity of the print substrate 100, 200 to fall within the print range.

In some examples, the coating material may be in the form of a film forming coating (i.e. a coating material that forms a polymeric film on the surface after curing). In some examples, the coating material may be a polyethyleneimine (PEI) based material such as Michelman Sapphire®, Michelman Digiprime®060, Michelman Digiprime®050 or the like. In some examples, the coating material may be an ethylene acrylic acid (EAA) based material such as Michelman Digiprime® 4431, Michem® In-Line Primer 030 or the like.

The coating material may include an anti-static agent and, where there are different levels of coating material provided, the coating material may include different proportions of anti-static agent at each level. In some examples, the anti-static agent may be, for example, an ionic liquid mixed into the coating material. The ionic liquid may consist of, for example, imidazolium or ammonium cations. In some examples, the antistatic agent may be a solid state salt (i.e. powder or crystals that can dissolve in water) added to the coating material. The solid state salts may be, for example, NaCl, KCl, $Na_2SO_4$ or any other solid state salt. The anti-static agent may be selected by the processing module 604 using weight relation calculations.

In some examples, the processing module 604 may select a concentration for the coating material. For example, the coating material may be formed by adding an imidazolium ionic liquid in 10% (w/w) concentration to a polyethylene imine resin dispersion. In other examples, the concentrations may be 3%, 9%, 15%, etc. However, it will be understood that other coating materials and concentrations are also possible.

The processing module 604 may select a coating material to have a certain weight to obtain a desired surface resistivity. In some examples, the coating material may be selected to have a weight in the range of 0.8 and 4 gsm when wet. The processing module 604 may select a thickness in which the coating material is to be applied by the application module 606. The processing module 604 may select a number of layers of coating material to be applied by the application module 606 (such as one layer, two layers, three layers, etc).

Figure 3D:
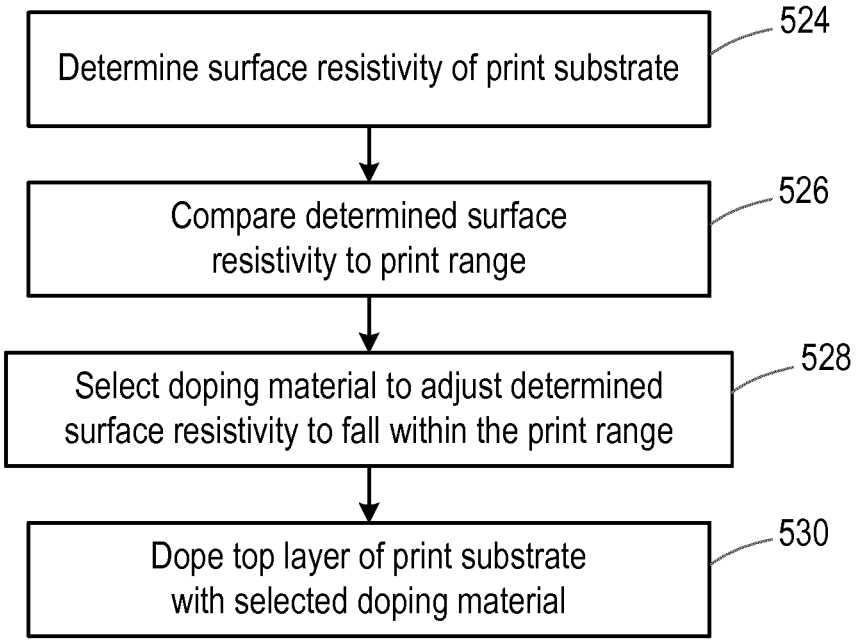
FIG. 3D is an example illustration of a method which may be employed according to the present disclosure.

In the example illustrated in FIG. 3D, at block 528, selecting a surface modification 102, 202 to adjust the determined surface resistivity of the print substrate 100, 200 to fall within the print range may comprise the processing module 604 selecting a doping material to adjust the determined surface resistivity of the print substrate 100, 200 to fall within the print range. The doping material may be a material such as those described above with reference to the coating material. The processing module 604 may select a quantity and/or a concentration of doping material to adjust the determined surface resistivity of the print substrate 100, 200 to fall within the print range.

With reference to FIGS. 3A and 3B, at block 506, 514, the application module 606 applies the selected surface modification 102, 202 to the top layer 104, 204 of the print substrate 100, 200.

In the example illustrated in FIG. 3C, at block 522, the application module 606 may apply a selected coating material to the top layer 104, 204 of the print substrate 100, 200. In other words, applying the surface modification 102, 202 to a top layer 104, 204 of the print substrate 100, 200 may comprise the application module 606 coating a top layer 104, 204 of the print substrate 100, 200 with a selected coating material.

In some examples, the application module 606 may apply the selected coating material by coating the top layer 104, 204 of the print substrate 100, 200 with one or more layers of the coating material. The coating of the top layer 104, 204 may be performed using any suitable coating technique (for example, gravure). In some examples, applying the surface modification 102, 202 to a top layer 104, 204 of the print substrate 100, 200 may comprise the application module 606 coating a top layer 104, 204 of the print substrate 100, 200 with the selected coating material having a weight and in a thickness selected by the processing module 604. In other words, a layer of coating material may be formed to a selected thickness. In some examples, a layer of coating material may have a thickness of approximately 1 μm. In other examples, a layer of coating material may have a thickness of approximately 2 μm. In some examples, a layer of coating material may have a thickness in the range of approximately 1-2 μm.

The application module 606 may apply the coating material to the print substrate 100 using any appropriate technique. For example, the application module 606 may apply the coating material to the top layer 104, 204 of the print substrate 100, 200 using an applicator such as a roller (for example, a 1.2 BCM anilox roller) or a rod (for example, a RDS2 or RDS3 rod).

In the example illustrated in FIG. 3D, at block 530, the application module 606 may introduce a selected doping material into the top layer 104, 204 of the print substrate 100, 200. In other words, applying the surface modification to a top layer of the print substrate may comprise the application module 606 doping (or contaminating) the top layer of the print substrate with a selected doping material.

In the example shown in FIG. 1, the top layer of the print substrate 100 is the conductive layer 104 and the application module 606 applies the surface modification 102 to the conductive top layer 104. In this example, at block 504, the surface modification 102 is selected by the processing module 604 to promote or increase the resistivity of the print substrate 100. For example, at block 504, the processing module 604 may select a surface modification to adjust the determined surface resistivity of the print substrate to fall within the print range by selecting a resistive agent to adjust the determined surface resistivity of the print substrate to fall within the print range. At block 506, the application module 606 may then apply the selected resistive agent to the conductive top layer 104 of the print substrate 100.

In an example, the application module 606 may apply the selected resistive agent to the conductive top layer 104 of the print substrate 100 by coating the conductive top layer 104 with one or more layers of the selected resistive agent. In one example, the application module 606 may apply the selected resistive agent to the conductive top layer 104 by coating the conductive top layer 104 with two layers of the selected resistive agent with each layer of resistive agent having a thickness of approximately 1 μm. In some examples, a layer of resistive agent may be in the form of a solid ink layer. In some examples, the layer of resistive agent may be a plastic. The application module 606 may apply the resistive agent to the conductive top layer 104 as a thin top coating to control the surface conductivity. Other examples of the resistive agent for coating may be any of those described earlier with respect to the coating material or any other resistive agent to promote or increase the resistivity of the print substrate 100.

The application module 606 may apply the resistive agent to the print substrate 100 using any appropriate technique. For example, the application module 606 may apply the resistive agent to the conductive top layer 104 of the print substrate 100 using an applicator such as a roller (for example, a 1.2 BCM anilox roller) or a rod (for example, a RDS2 or RDS3 rod).

In another example, the application module 606 may apply the selected resistive agent to the conductive top layer 104 of the print substrate 100 by doping the conductive top layer 104 with the selected resistive agent. Examples of the resistive agent for doping may be any of those described earlier with respect to the coating material or any other resistive agent to promote or increase the resistivity of the print substrate 100.

In the example shown in FIG. 2, the top layer of the print substrate 200 is the resistive layer 204 and the application module 606 applies the surface modification 202 to the resistive top layer 204. In this example, at block 504, the surface modification 202 is selected by the processing module 604 to promote or increase the conductivity of the print substrate. For example, at block 506, the processing module 604 may select a surface modification to adjust the determined surface resistivity of the print substrate to fall within the print range by selecting a conductive agent to adjust the determined surface resistivity of the print substrate to fall within the print range. At block 506, the application module 606 may then apply the selected conductive agent to the resistive top layer 204 of the print substrate 200.

In an example, the application module 606 may apply the selected conductive agent to the resistive top layer 204 of the print substrate 200 by coating the resistive top layer 204 with one or more layers of the selected conductive agent. In one example, the conductive agent may be in the form of an aqueous polymeric solution. For example, the conductive agent may be in the form of an ionic liquid and may comprise conductive salts (such as cations of ammonium or imidazolium). In some examples, the conductive agent may be in the form of an antistatic agent. The application module 606 may apply the conductive agent to the resistive top layer 204 as a layer of plastic film and the surface conductivity of the resistive top layer 204 may be raised by the addition of a resin having conductive characteristics. Other examples of the conductive agent for coating may be any of those described earlier with respect to the coating material or any other conductive agent to promote or increase the conductivity of the print substrate 200.

The application module 606 may apply the conductive agent to the print substrate 200 using any appropriate technique. For example, the application module 606 may apply the conductive agent 202 to the resistive top layer 204 of the print substrate 200 using an applicator such as a roller (for example, a 1.2 BCM anilox roller) or a rod (for example, a RDS2 or RDS3 rod).

In another example, the application module 606 may apply the selected conductive agent to the resistive top layer 204 of the print substrate 200 by doping the resistive top layer 204 with the selected conductive agent. Examples of the conductive agent for doping may be any of those described earlier with respect to the coating material or any other conductive agent to promote or increase the conductivity of the print substrate 100.

As described above, the surface modification 102, 202 is selected to adjust the surface resistivity of the print substrate 100, 200 to fall within a print range having a lower threshold value for the surface resistivity of the print substrate 100, 200 and an upper threshold value for the surface resistivity of the print substrate 100, 200.

The lower threshold value for the surface resistivity of the print substrate 100, 200 may be a value of 1 MΩ/□, 1.2 MΩ/□, 1.3 MΩ/□, 1.4 MΩ/□, 1.5 MΩ/□, 1.6 MΩ/□, 1.7 MΩ/□, 1.8 MΩ/□, 1.9 MΩ/□, 2 MΩ/□, 2.1 MΩ/□, 2.2 MΩ/□, 2.3 MΩ/□m 2.4 MΩ/□, or 2.5 MΩ/□. In one example, the lower threshold value for the surface resistivity of the print substrate 100, 200 may be at least 1.5 MΩ/□. In another example, the lower threshold value for the surface resistivity of the print substrate 100, 200 may be at least 2 MΩ/□.

The upper threshold value for the surface resistivity of the print substrate 100, 200 may be a value of 50 MΩ/□, 60 MΩ/□, 70 MΩ/□, 80 MΩ/□, 90 MΩ/□, 100 MΩ/□, 110 MΩ/□, 120 MΩ/□, 130 MΩ/□, 140 MΩ/□, 150 MΩ/□, 160 MΩ/□, 170 MΩ/□, 180 MΩ/□, 190 MΩ/□, or 200 MΩ/□. In one example, the upper threshold value for the surface resistivity of the print substrate 100, 200 may be less than or equal to 150 MΩ/□. In another example, the upper threshold value for the surface resistivity of the print substrate 100, 200 may be less than or equal to 100 MΩ/□.

In a specific example, the lower threshold value for the surface resistivity of the print substrate 100, 200 may be a value of 1.5 MΩ/□ and the upper threshold value for the surface resistivity of the print substrate 100, 200 may be a value of 150 MΩ/□. In other words, the print range may include a surface resistivity of the print substrate 100, 200 from 1.5 MΩ/□ to 150 MΩ/□.

In another specific example, the lower threshold value for the surface resistivity of the print substrate 100, 200 may be a value of 2 MΩ/□ and the upper threshold value for the surface resistivity of the print substrate 100, 200 may be a value of 150 MΩ/□. In other words, the print range may include a surface resistivity of the print substrate 100, 200 from 2 MΩ/□ to 150 MΩ/□.

In another specific example, the lower threshold value for the surface resistivity of the print substrate 100, 200 may be a value of 1.5 MΩ/□ and the upper threshold value for the surface resistivity of the print substrate 100, 200 may be a value of 100 MΩ/□. In other words, the print range may include a surface resistivity of the print substrate 100, 200 from 1.5 MΩ/to 100 MΩ/□.

In another specific example, the lower threshold value for the surface resistivity of the print substrate 100, 200 may be a value of 2 MΩ/□ and the upper threshold value for the surface resistivity of the print substrate 100, 200 may be a value of 100 MΩ/□. In other words, the print range may include a surface resistivity of the print substrate 100, 200 from 2 MΩ/□ to 100 MΩ/□.

The example print ranges with the lower and upper threshold values for the surface resistivity of the print substrate 100, 200 apply to each of the examples described above. It will be understood that other print ranges are possible.

As discussed above, according to the present disclosure, there is provided a print substrate (or print media) 100, 200 comprising a conductive layer 104, 206 and a top layer 104, 204 with an applied surface modification 102, 202. The surface resistivity of the print substrate 100, 200 according to the present disclosure is within a print range having a lower threshold value for the surface resistivity of the substrate 100, 200 and an upper threshold value for the surface resistivity of the substrate 100, 200 due to the surface modification 102, 202 applied to the top layer 104, 204 of the print substrate 100, 200.

The print substrate 100, 200 of the present disclosure may be used in a method of printing an image. For example, the print substrate 100, 200 may be for use in electrophotographic printing.

Figure 4:
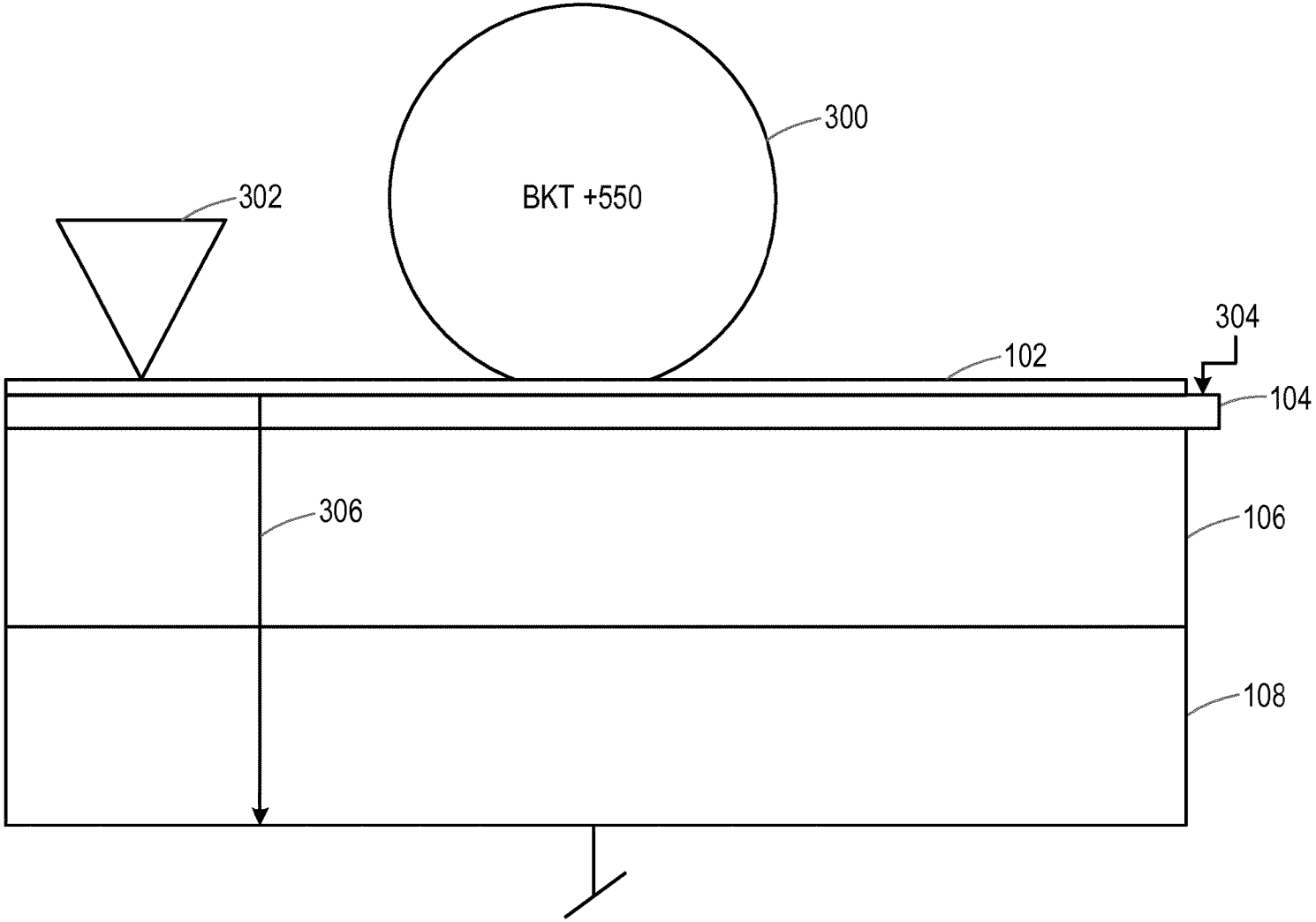
FIG. 4 is a block diagram of an example apparatus for printing on an example of a print substrate according to the present disclosure.
Figure 5:
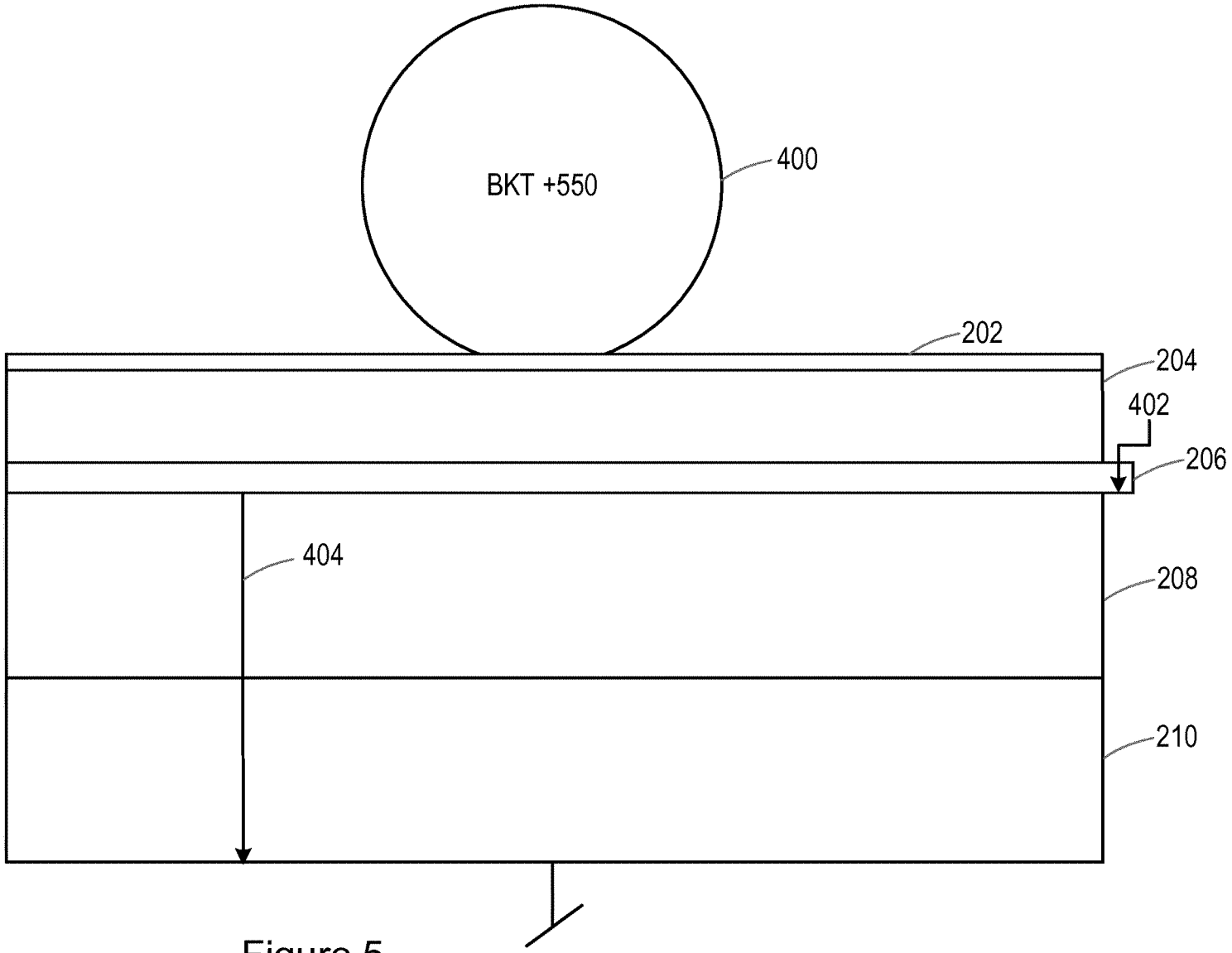
FIG. 5 is a block diagram of an example apparatus for printing on an example of a print substrate according to the present disclosure.

FIG. 4 illustrates an example print apparatus for printing on the print substrate of FIG. 1 and FIG. 5 illustrates an example print apparatus for printing on the print substrate of FIG. 2. In the print apparatus, the print substrate 100, 200 is placed on a media 108, 210, which is wrapped around an impression cylinder (not shown). The substrate 108, 210 may be held in place by gripper 304, 402 and may be grounded via grounding elements 302. During a printing process, a final image film may be transferred from a blanket cylinder 300, 400 onto the print substrate 100, 200.

Figure 7:
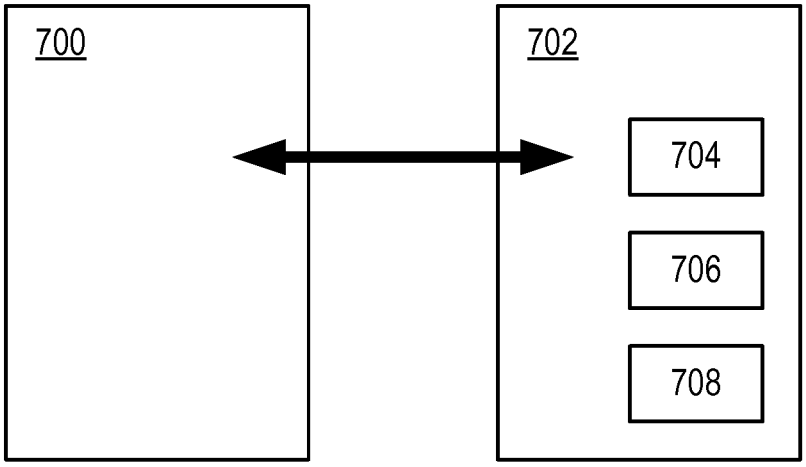
FIG. 7 is a block diagram of a computing system according to the present disclosure.

FIG. 7 is a block diagram of a computing system according to the present disclosure. There is provided a non-transitory machine-readable storage medium 702 encoded with instructions 704, 706, 708 executable by a processor 700. The machine-readable storage medium comprises instructions to perform at least part of the method described herein. For example, the machine-readable storage medium comprises instructions 704 to determine a surface resistance of a print media comprising a conductive layer, instructions 706 to compare the determined surface resistance to a print range having a lower threshold value for the surface resistance of the print media and an upper threshold value for the surface resistance of the print media and, if the determined resistance of the print media is outside the print range, select a surface modification to alter the determined surface resistance of the print media to be within the print range, and instructions 708 to apply the selected surface modification to a top layer of the print media.

EXAMPLES

The following examples are to be understood as being illustrative of the application of the principles of the present disclosure. Numerous modifications and alternative compositions and methods may be devised without departing from the spirit and scope of the present disclosure. Thus, these examples should not be considered as limitations of the present disclosure, but are merely in place to teach how to make and use compositions of the present disclosure.

An example relates to a print substrate (also referred to as a media or sheet) with a conductive top layer. The print substrate with a conductive top layer was observed with a scope connected to a test point and spikes were observed in an ITM power supply. The print substrate was observed as solid ink layers were printed on top of the print substrate. Each ink layer was approximately 1 m thick.

The spikes that appeared during the printing of the first layer were greatly reduced during the laying of the second layer and were completely eliminated during the laying of the third layer and onwards. The surface resistivity of the print substrate with two layers was measured at approximately 1.5 MΩ/. For a 600V blanket, the expected current is 600V/1.5 MΩ=0.4 mA, which is a low current. Maximal current of the power supply of the press in test was 20 mA.

Another example relates to a print substrate (also referred to as a media or sheet) with a resistive top layer. The print substrate showed strong cling to other print sheets. When measured with an electrometer, the sheets displayed a surface potential of a few 10 s and up to 200 volts. The sheets were coated with a primer containing a conductive salt. The conductive salt included ionic liquids comprising cations of ammonium or imidazolium types, or any other conductivity promoters for aqueous polymeric solutions.

BASF EFKA® IO 6785 (imidazolium ionic liquid) was added in 15% (w/w) concentration to Michelman Digiprime® 060 primer (polyethylene imine resin) and was applied with a 1.2 BCM anilox roller on resistive top substrate. The coating resulted in a surface resistivity of 20-30 MΩ/.

Other concentrations of 10%, 9% and 3% (w/w) were tested with the same primer, conditions and substrate, and resistivity measurements showed a surface resistivity of approximately 100 MΩ/, 230M kΩ/ and 800 MΩ/ Under a surface resistivity of 100 MΩ/, there was no measureable cling and no measurable potential on the sheets after printing. At 230 Mohm, a cling of very few Newton was observed, which did not impede any finishing, and a few 10 s of volts charging was recorded. At about 800 Mohm, a cling of a few Newton was observed and a high charging of up to 200 volts.

The above described method may apply at various levels in a printing process. For example, the method may be programmed internally in a printer. In another example, a non-transitory machine-readable storage medium may be encoded with instructions executable by a processor to perform the method. The method may be used in conjunction with any other programs for processing a three-dimensional object (for example, programs that process three-dimensional models with texture maps).

Examples in the present disclosure can be provided as methods, systems or machine-readable instructions, such as any combination of software, hardware, firmware or the like. Such machine-readable instructions may be included on a machine-readable storage medium (including but is not limited to disc storage, CD-ROM, optical storage, Random Access Memory (RAM), an Electrically-Erasable Programmable Read-Only Memory (EEPROM), a storage drive, etc.) having machine-readable program code therein or thereon. In some examples, the machine-readable storage medium may be non-transitory.

The present disclosure is described with reference to flow charts and/or block diagrams of the method, apparatus and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realised by machine-readable instructions.

The machine-readable instructions may, for example, be executed by a general purpose computer, a special purpose computer, an embedded processor or processors of other programmable data processing devices to realise the functions described in the description and figures. For example, a processing apparatus or processor may execute the machine-readable instructions. Thus, functional modules (such as the measurement module 602, processing module 604, and application module 606 described herein) of the apparatus and devices may be implemented by a processor executing machine-readable instructions stored in a memory, or a processor operating in accordance with instructions embedded in logic circuitry. Generally, modules may be any combination of hardware and programming to implement the functionalities of the respective modules. In some examples, the combinations of hardware and programming may be implemented by a processor and executable instructions stored on a non-transitory machine-readable storage medium. The term "processor" is to be interpreted broadly to include a processing unit, central processing unit (CPU), application-specific integrated circuit (ASIC), logic unit, programmable gate array, etc. The methods and functional modules may all be performed by a single processor or divided amongst several processors.

Such machine-readable instructions may also be stored in a machine-readable storage that can guide the computer or other programmable data processing devices to operate in a specific mode.

Such machine-readable instructions may also be loaded onto a computer or other programmable data processing devices, so that the computer or other programmable data processing devices perform a series of operations to produce computer-implemented processing, thus the instructions executed on the computer or other programmable devices provide a means for realising functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit and scope of the present disclosure. It should be noted that the above-mentioned examples illustrate rather than limit what is described herein, and that many alternative implementations may be designed without departing from the scope of the appended claims. For example, a feature or block from one example may be combined with or substituted by a feature/block of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

determining a surface resistivity of an electrically conductive top layer of a print substrate;

comparing the determined surface resistivity to a print range having a lower threshold value for the surface resistivity of the print substrate and an upper threshold value for the surface resistivity of the print substrate;

in response to the determined surface resistivity of the electrically conductive top layer being outside the print range, selecting a doping material to adjust the surface resistivity of the electrically conductive top layer to fall within the print range, wherein the doping material is selected from the group consisting of polyethyleneimine, an ethylene acrylic acid, an anti-static agent comprising ionic liquid, and an anti-static agent comprising a solid state salt; and doping the electrically conductive top layer of the print substrate with the selected doping material.

2. The method of claim 1, wherein the selecting of the doping material to adjust the surface resistivity of the electrically conductive top layer to fall within the print range comprises:

selecting the doping material to decrease the surface resistivity of the electrically conductive top layer to fall within the print range.

3. The method of claim 1, wherein the lower threshold value of the print range for the surface resistivity of the electrically conductive top layer is a value of at least 1.5MΩ/□ or 2MΩ/□.

4. The method of claim 1, wherein the upper threshold value of the print range for the surface resistivity of the electrically conductive top layer is a value less than or equal to 150MΩ/□ or 100MΩ/□.

5. The method of claim 1, further comprising:

printing an image using the print substrate after doping the electrically conductive top layer of the print substrate with the selected doping material.

6. A method comprising:

determining a surface resistivity of an electrically conductive top layer of a print substrate;

comparing the determined surface resistivity to a print range having a lower threshold value for the surface resistivity of the print substrate and an upper threshold value for the surface resistivity of the print substrate;

in response to the determined surface resistivity of the electrically conductive top layer being outside the print range, selecting a doping material to adjust the surface resistivity of the electrically conductive top layer to fall within the print range, wherein the doping material comprises polyethyleneimine or an ethylene acrylic acid; and doping the electrically conductive top layer of the print substrate with the selected doping material.

7. The method of claim 6, further comprising:

printing an image using the print substrate after the doping.

8. A method comprising:

determining a surface resistivity of an electrically conductive top layer of a print substrate;

comparing the determined surface resistivity to a print range having a lower threshold value for the surface resistivity of the print substrate and an upper threshold value for the surface resistivity of the print substrate;

in response to the determined surface resistivity of the electrically conductive top layer being outside the print range, selecting a doping material to adjust the surface resistivity of the electrically conductive top layer to fall within the print range, wherein the doping material comprises an anti-static agent that comprises an ionic liquid or a solid state salt; and doping the electrically conductive top layer of the print substrate with the selected doping material.

9. The method of claim 8, further comprising:

printing an image using the print substrate after the doping.

* * * * *